United States Patent [19]

Focke et al.

[11] Patent Number: 4,636,186

[45] Date of Patent: Jan. 13, 1987

[54] APPARATUS FOR SETTING AND SHAPING GLUED CIGARETTE PACKS

[75] Inventors: Heinz Focke; Hans Schönberger, both of Verden, Fed. Rep. of Germany

[73] Assignee: Focke & Co. (GmbH & Co.), Verden, Fed. Rep. of Germany

[21] Appl. No.: 683,109

[22] Filed: Dec. 18, 1984

[30] Foreign Application Priority Data

Jan. 11, 1984 [DE] Fed. Rep. of Germany ..... 3400650

[51] Int. Cl.[4] ..... B31B 3/62

[52] U.S. Cl. ..... 493/142; 493/147; 493/332; 53/234; 53/388

[58] Field of Search ..... 493/142, 147, 332, 910, 493/265; 34/209, 216; 53/388, 387, 234

[56] References Cited

U.S. PATENT DOCUMENTS

| | | | |
|---|---|---|---|
| 90,711 | 1/1869 | White | 493/332 |
| 1,876,931 | 9/1932 | Heywood et al. | 493/106 |
| 1,934,540 | 11/1933 | Heywood | 493/332 |
| 2,512,922 | 6/1950 | Dearsley | 493/910 |
| 2,591,135 | 4/1952 | Chalmers et al. | 493/142 |
| 3,385,176 | 5/1968 | Whitaker | 493/910 |
| 3,899,863 | 8/1975 | Seragnoli et al. | 53/53 |
| 4,084,393 | 4/1978 | Focke | 53/137 |
| 4,100,718 | 7/1978 | Focke et al. | 493/910 |
| 4,170,073 | 10/1979 | Ignatowicz | 34/31 |
| 4,179,864 | 12/1979 | Focke | 53/388 |
| 4,265,073 | 5/1981 | Seragnoli | 53/542 |
| 4,308,667 | 1/1982 | Roos et al. | 34/23 |
| 4,308,708 | 1/1982 | Focke | 53/137 |
| 4,330,976 | 5/1982 | Blackall et al. | 53/151 |
| 4,484,432 | 11/1984 | Oberdorf | 53/575 |
| 4,559,758 | 12/1985 | Gamberini | 53/207 |

FOREIGN PATENT DOCUMENTS

| | | | |
|---|---|---|---|
| 1071001 | 2/1980 | Canada | 493/142 |

*Primary Examiner*—Francis S. Husar
*Assistant Examiner*—William E. Terrell
*Attorney, Agent, or Firm*—Sughrue, Mion, Zinn, Macpeak and Seas

[57] ABSTRACT

Cuboid (cigarette) packs (10) are conventionally provided with folding tabs joined by glueing. So that the adhesive can set before the packs (10) are exposed to loads, a first drying turret (14) is provided for temporarily receiving the packs (10) in individual pockets (15), and a further drying turret (18), in which one pack group (23) is received in each pocket (22), is provided for the final drying or hardening of the adhesive.

13 Claims, 7 Drawing Figures

APPARATUS FOR SETTING AND SHAPING GLUED CIGARETTE PACKS

DESCRIPTION

Figure 1:
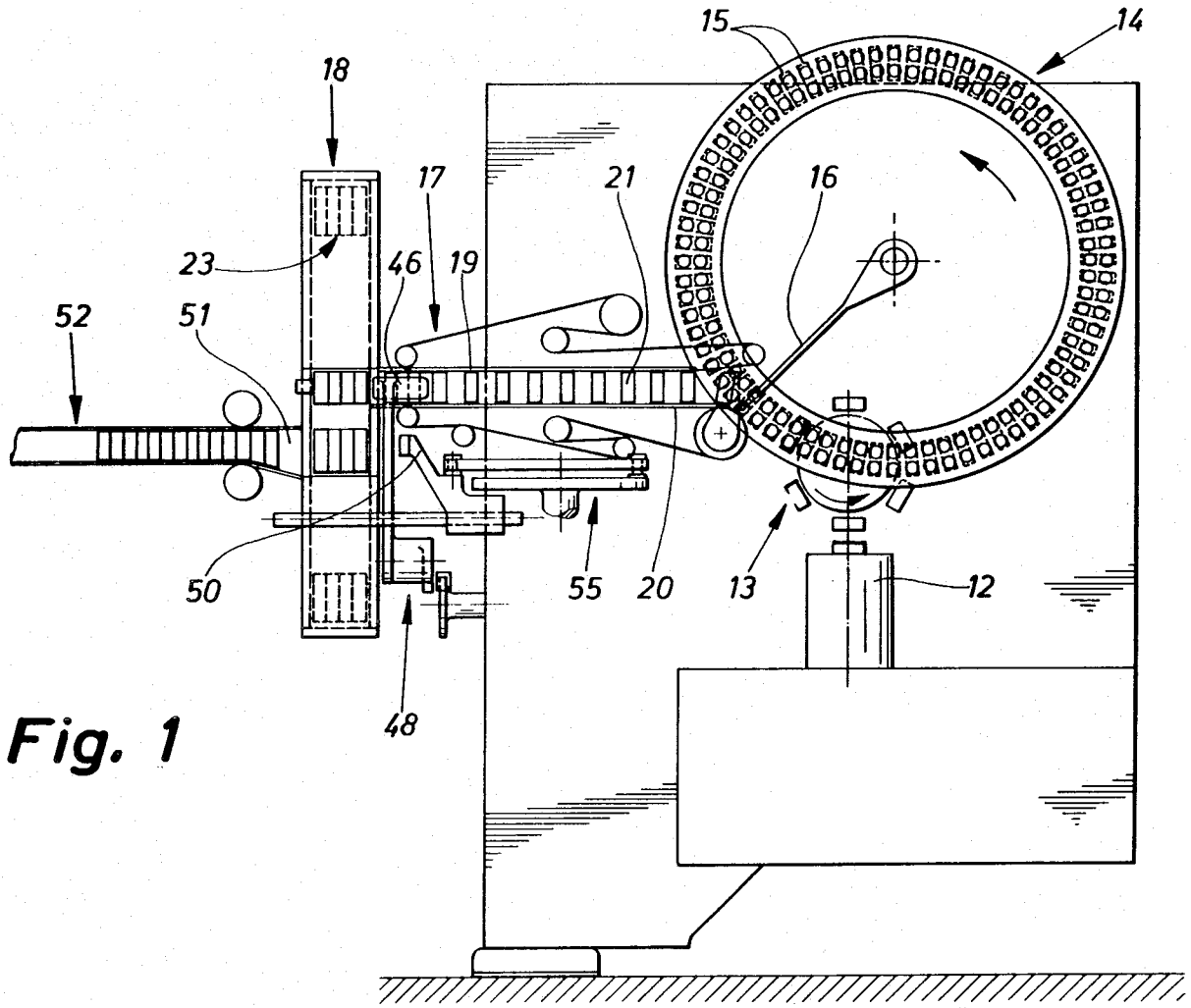

The invention relates to an apparatus for producing packs with folding tabs joined by means of glueing, especially cigarette packs made of (thin) cardboard, which packs are supplied to a drying turret immediately after completion.

The invention is primarily concerned with problems arising in the production of cuboid cigarette packs, in particular so-called hinge-lid packs. In these, side tabs forming narrow side faces are joined to one another by means of glueing. So that the adhesive has the opportunity of setting, without the folding tabs glued to one another being able to shift relative to one another during this time, the finished packs are received temporarily in a drying turret. An advantageous embodiment of this is described in U.S. Pat. No. 4,179,864. This known drying turret forming part of the packaging machine is provided, along its periphery, with a plurality of radially directed pockets each of which serves to receive a pack. The pockets of the drying turret are designed so that the exact cuboid format of the packs is maintained or stabilized. When the packs leave the drying turret after a retention time of, for example, 15 seconds, the glue bond between the folding tabs has hardened substantially, and furthermore the shape of the packs is fixed precisely.

The object on which the invention is based is to develop further and improve a packaging machine of the type described in the introduction, in such a way that it is possible to stabilize folding tabs joined to one another by means of glueing, whilst at the same time ensuring a high output of the packaging machine, and even in the case of packs where glueing is critical.

To achieve this object, the apparatus according to the invention is defined in that the (first) drying turret is followed by at least one further (second) drying turret for receiving the packs temporarily.

The first drying turret known per se causes initial setting or hardening of the adhesive, whilst at the same time maintaining and fixing the external shape of the pack precisely, especially the cuboid shape. The following further drying turret preferably has a simpler design in the form of pockets for receiving the packs. The packs are also retained in this second drying turret, so that packs having glue bonds of high strength or stability leave the drying turret and can then be supplied to further packaging steps without delay.

Several, especially two, drying turrets connected in series, by means of which the total retention time of the packs in these turrets is increased, are particularly advantageous when packs are produced from packaging material which is metal-coated or which is difficult to glue for other reasons. Blanks coated with metal or other materials reacting in a similar way are particularly conventional for cigarette packs.

The second following drying turret is provided, along its periphery, with pockets, in each of which a plurality of packs located next to one another in the axial direction (pack group) is received. The packs coming from the first drying turret travel via a feed conveyor to the second drying turret and directly into a pocket provided in a feed station. Because of their shape, the pockets allow the packs or pack group to move in the axial direction through the pocket, entering on one side of the turret and leaving on the other side in the region of adjacent feed and push-out stations.

The cigarette groups, each to be received by a pocket, are formed as a result of the accumulation of continuously supplied packs within a pocket, and the following packs are temporarily prevented from being transported further by being clamped. After a virtually complete revolution of the cigarette group in a pocket, the pack group as a whole is ejected from the pocket and moved up to a discharge conveyor by means of a slide.

The apparatus formed is efficient in terms of the number of packs produced and guarantees packs of perfect quality.

Figure 2:
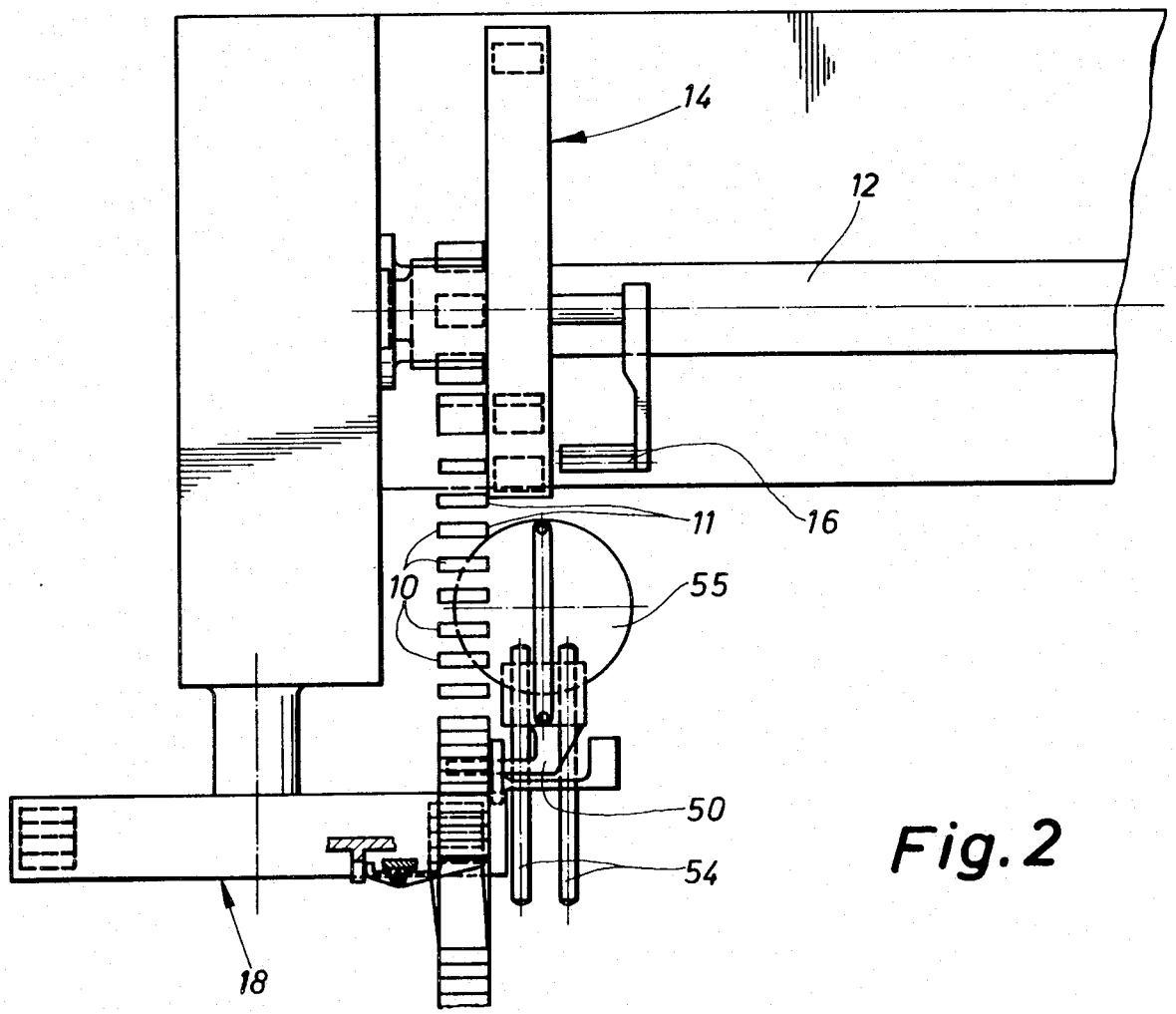
Figure 3:
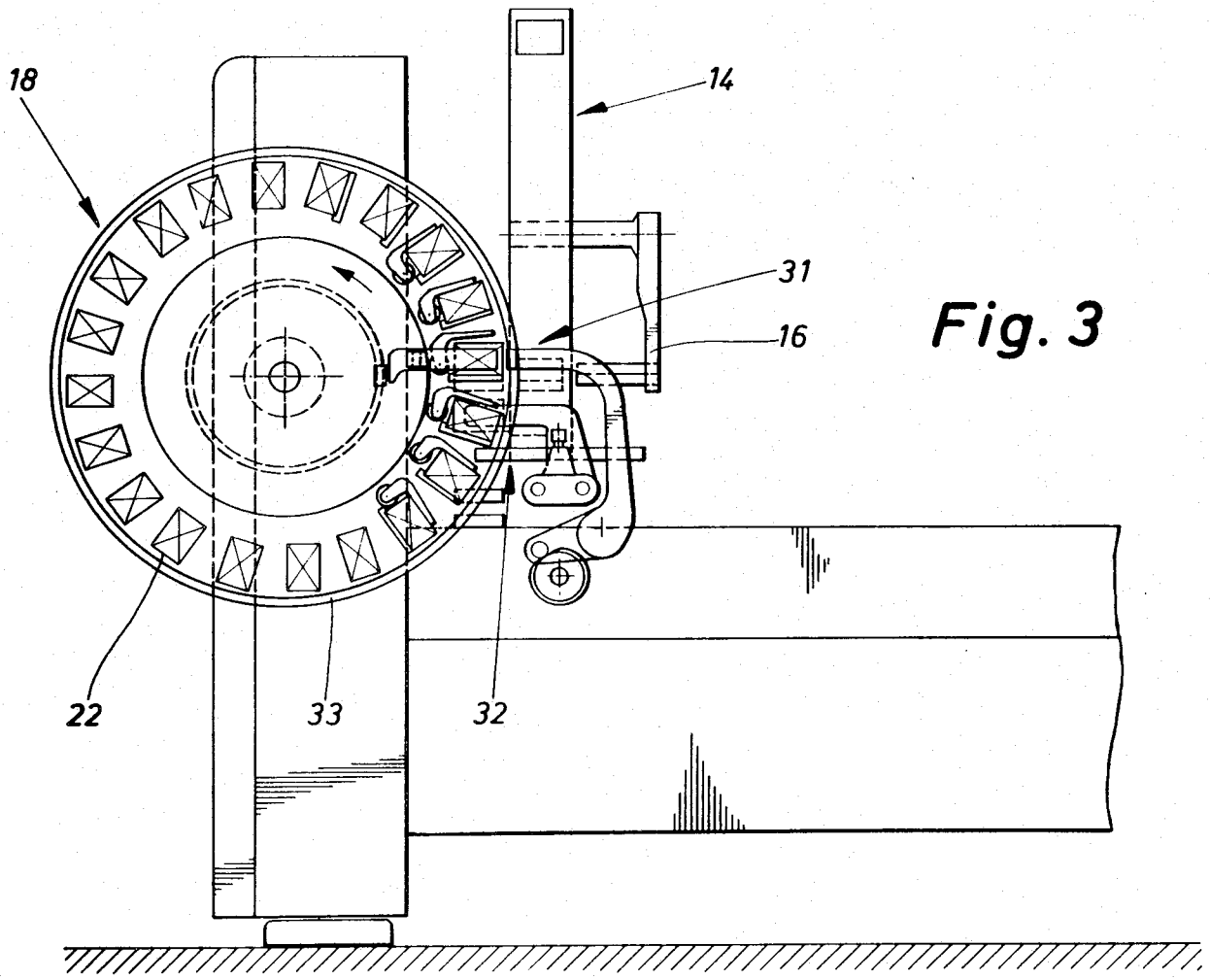
Figure 4:
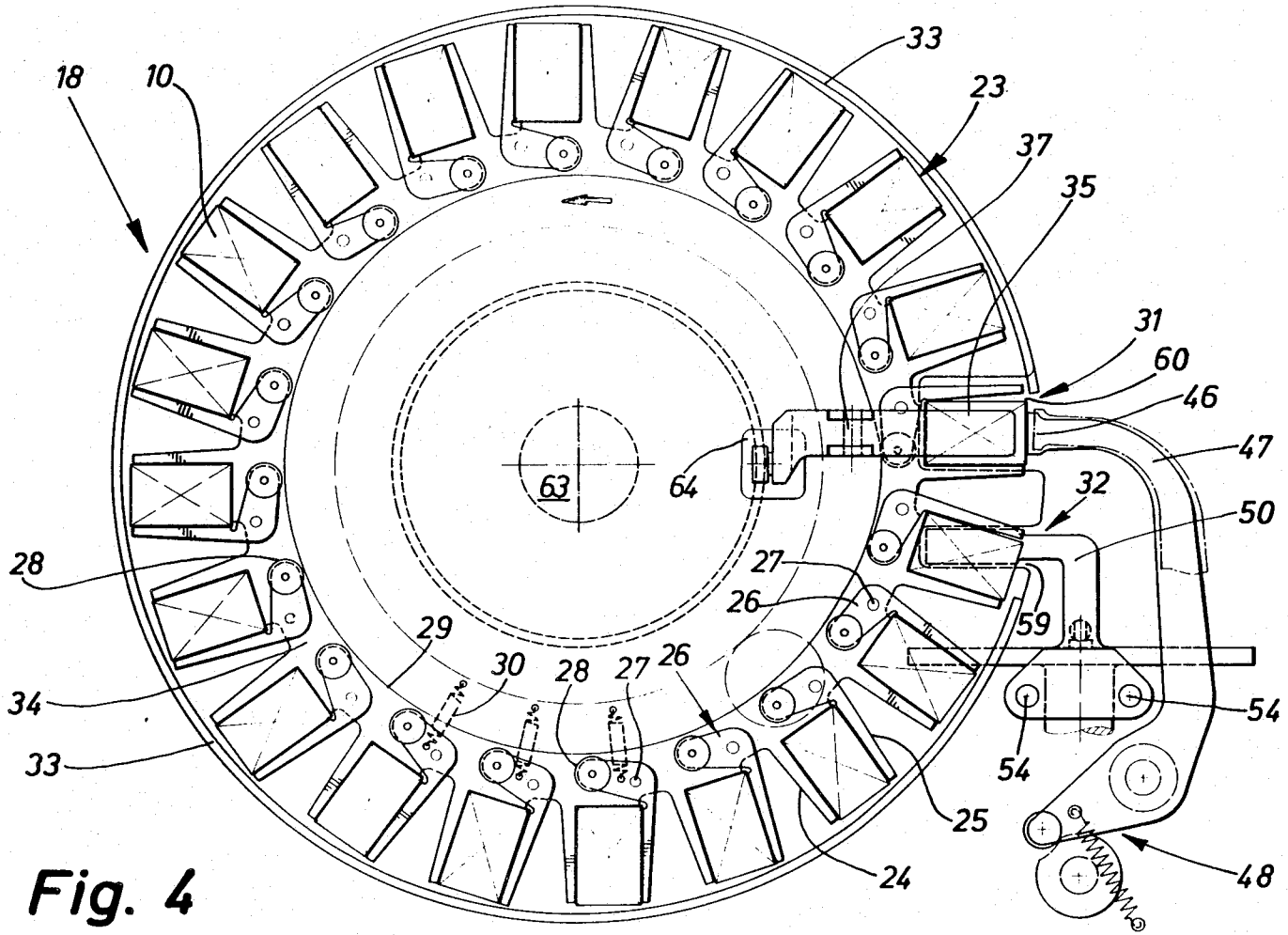
Figure 5:
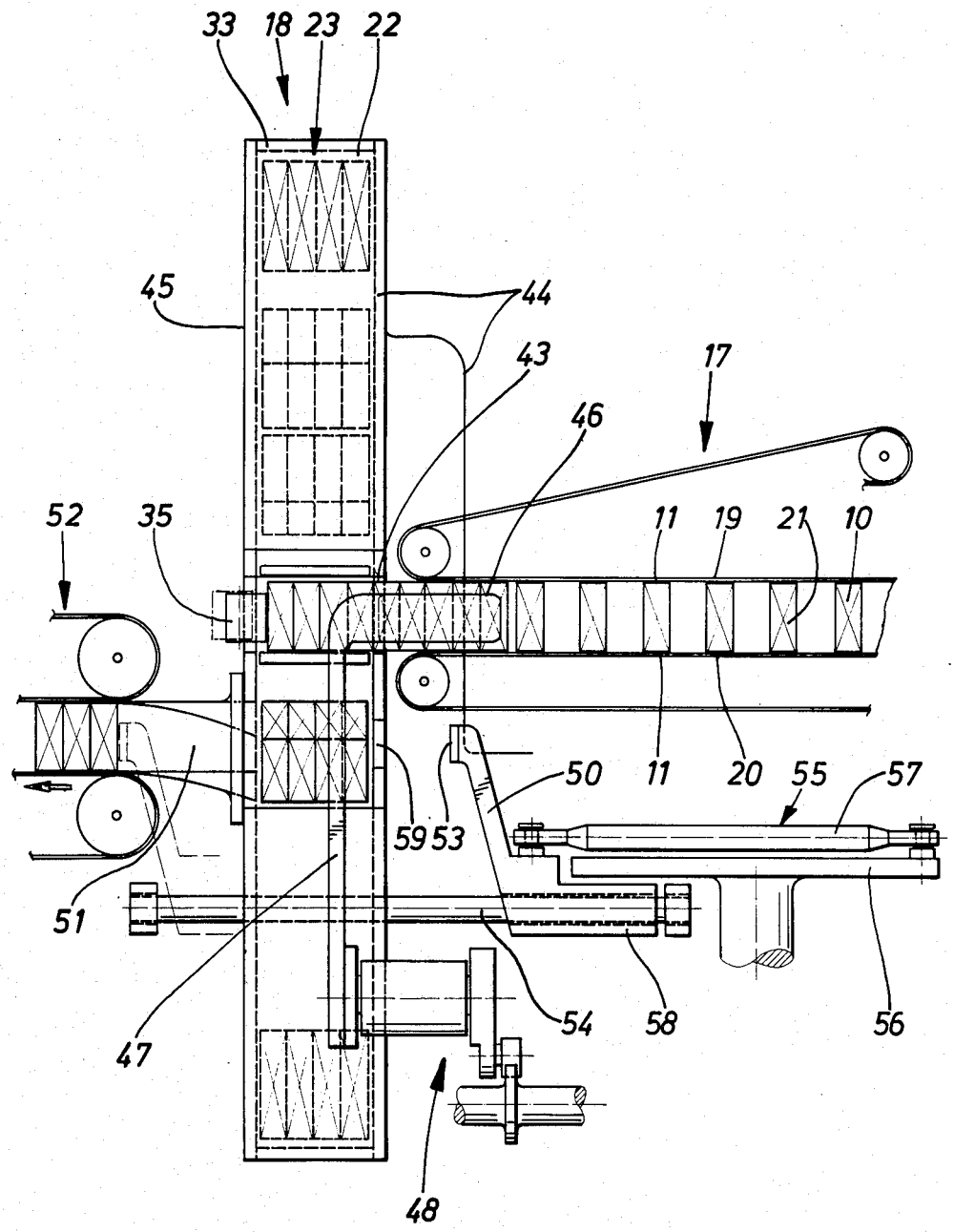
Figure 6:
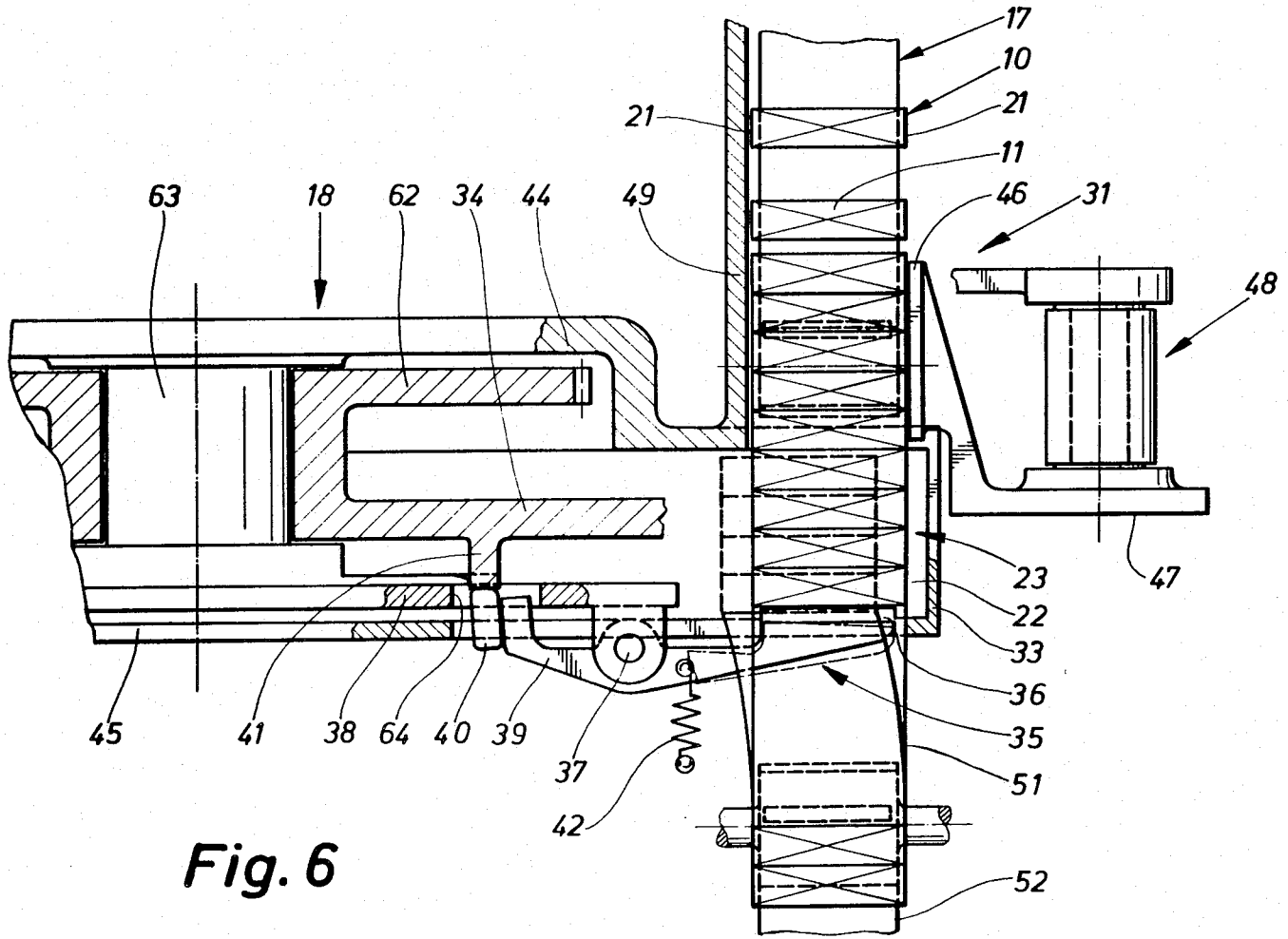
Figure 7:
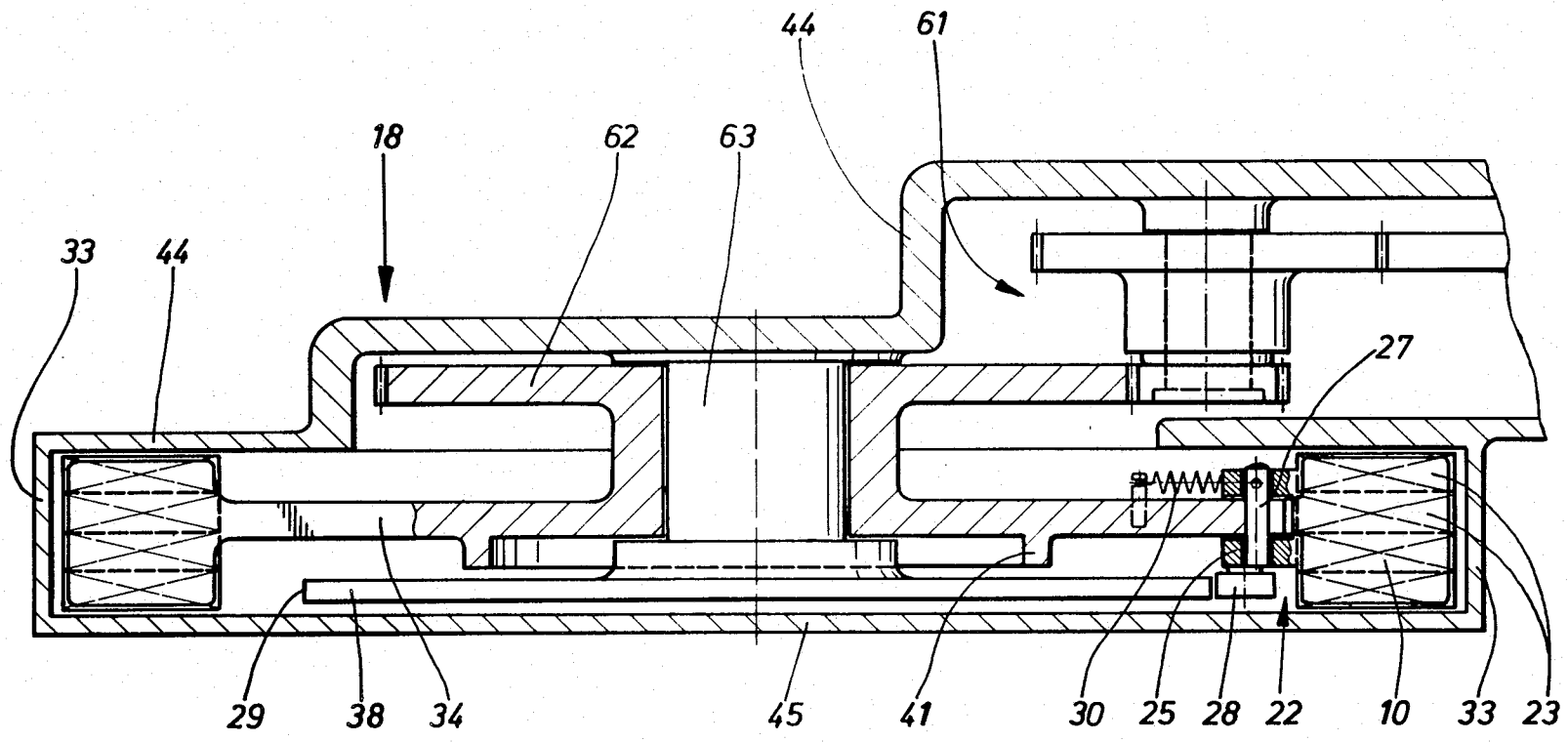

An exemplary embodiment of the apparatus is explained in more detail below with reference to the drawings in which:

FIG. 1 shows the relevant part of the packaging machine in a diagrammatic side view, FIG. 2 shows a horizontal projection of FIG. 1, FIG. 3 shows a view of the apparatus offset 90° relative to FIG. 1, with a plan view of a second drying turret, FIG. 4 shows a side view of the drying turret as a detail, on an enlarged scale, FIG. 5 shows a view of the (second) drying turret, offset 90° relative to FIG. 4, together with the feed and discharge members, FIG. 6 shows a detail of the (second) drying turret in the region where the packs are pushed in, in a horizontal section and on an enlarged scale, FIG. 7 shows a horizontal or radial section through the drying turret, offset in the peripheral direction relative to FIG. 6.

The exemplary embodiment illustrated in the drawings relates to a packaging machine or parts of it for producing cuboid cigarette packs 10. These are preferably hinge-lid packs made of thin cardboard. The part of the packaging machine relating to the production of the actual pack 10 is not shown in detail, but preferably corresponds to the embodiment according to German Offenlegungsschrift No. 2,440,006 U.S. Pat. Nos. 4,084,393 and 4,308,708.

The cigarette packs 10 are formed so that side tabs overlapping one another in the region of narrow side faces 11 are joined together by means of adhesive. The cigarette packs 10, together with adhesive which has not yet hardened, are conveyed on a pack track 12, supplied to a transfer turret 13 by being lifted, and transferred from the latter to a first drying turret 14. This is preferably designed in the way described in U.S. Pat. No. 4,179,864, in particular with a plurality of radially directed pockets 15, each intended for receiving a cigarette pack 10. The pockets 15 are designed so that a forming pressure is exerted on the cigarette packs 10, and their cuboid shape is thereby corrected and stabilized. The packs are appropriately heated slightly in this first folding turret 14.

After one virtually complete rotation of the drying turret 14, the packs are pushed out of the pockets 15 by an ejector 16 (FIG. 2) and introduced into a belt conveyor which directly adjoins the drying turret 14 and which is at the same time a feed conveyor 17 for a further (second) drying turret 18.

The feed conveyor 17 (FIGS. 1, 2 and 5) consists of a revolving endless upper side 19 and a likewise endlessly revolving lower side 20. The cigarette packs 10 are received between these conveyor sides in a relative position in which the elongate side faces 11 are directed downwards and upwards, that is to say end faces 21 point to the sides.

The cigarette packs 10 are conveyed at a distance from one another by the feed conveyor 17 directly to the second drying turret 18 and into pockets 22 of the latter. At the same time, pack groups 23, each intended to be received in a pocket 22, are formed as a result of the accumulation of the cigarette packs 10. In the present exemplary embodiment, each pack group 23 assigned to a pocket 22 consists of four cigarette packs 10.

The drying turret 18 is arranged in a plane offset 90° relative to the first drying turret 14, both being in vertical planes. The pockets 22 of the second drying turret 18 are designed as axially continuous chambers or orifices, through which the pack group 23 is pushed in the axial direction. Each pocket consists of two side walls 24 and 25 (FIG. 4), of which one (the side wall 25) is moveable in the present case. This one wall is part of a two-armed wall lever 26 which is pivoted about a pivot bearing 27 and the free supporting arm of which is supported on a fixed cam disk 29 by means of a tracer roller 28. A (tension) spring 30 engaging on the free arm of the wall lever 26 ensures that the side wall 25 is loaded in the closing position. In the region of a feed station 31 and a push-out station 32, the side walls 25 are each opened counter to the tension of the spring 30 because the tracer roller 28 runs onto an elevation of the cam disk 29. The radially outer side of the pockets 22 is bounded by a fixed annular wall 33. A closed supporting disk 34, which rotates in synchronism and to which the fixed side walls 24 and the pivotable side walls 25 are also attached, forms the boundary of the pockets 22 on the opposite an inner side. The packs 10 are secured between the side walls 24 and 25 by being clamped.

The cigarette packs 10 transported by the feed conveyor 17 into the feed end of the pocket 22 located in the feed station 31 run or abut against a pocket stop 35 (FIGS. 4–7) on the opposite or exit side. In the present exemplary embodiment, this is designed as a two-armed lever with a stop projection 36 which projects into the pocket 22 from the exit side. A pivot bearing 37 is attached to a fixed retaining disk 38. One leg 39 of the pocket stop 35, this leg resting on the stop projection 36, is supported on a pot-shaped cam disk 41 by means of a track roller 40. A (tension) spring 42 engaging on the pocket stop 35 ensures that the track roller 40 constantly rests against the cam disk 41, and consequently the stop projection 36 is loaded in the direction of retraction.

When the pack group 23 is conveyed into the pocket 22, the stop projection 36 is in the position moved into the pocket 22 (the unbroken line in FIG. 6). The pack group 23 runs against the stop projection 36. When the drying turret 18 moves further, the stop projection 36 is retracted (the position shown by a broken line). The cigarette packs 10 can now be moved in the pocket 22 free of any load on them. A bevelled run-in edge 43 in a turret side-wall 44 causes the pack group 23 to be aligned in the pocket 22 as a result of slight displacement towards the opposite side (turret side-wall 45).

The pockets 22 are designed so that the cigarette packs 10 supplied at the height of a horizontal center plane are received in the pockets 22 with their end faces 21 directed radially outwards and inwards. The side faces 11 point in the peripheral direction.

To guarantee faultless further transport of the pack group 23 in the pocket 22, the following cigarette packs are stopped momentarily in the region of the feed conveyor 17. In the present case, the (accumulated) cigarette packs 10 located at the front in the direction of movement are stopped by being clamped. For this purpose, a clamping plate 46 (FIG. 6) is mounted, so as to be moveable, laterally next to the feed conveyor 17. This clamping plate is attached to an elongate lever arm 47 which is driven with a pulsating action by means of a suitable gear 48. In the position shown in FIG. 6, several cigarette packs are pressed by means of their end faces 21 against a fixed lateral guide 49 next to the feed conveyor 17. As soon as the next pocket 22 has been moved into the feed station 31, the clamping plate 46 is moved back, so that the accumulated cigarette packs 10 can be conveyed into the pocket 22. In the present exemplary embodiment, the lateral guide 49 is connected to the turret side-wall 44.

In the illustration of FIG. 4, the drying turret 18 is driven in an counter-clockwise direction. The cigarette packs are located in the pockets 22 of the drying turret 18 during a virtually complete revolution of the latter. The push-out station 32 is formed directly underneath the feed station 31. The pack group 23 is conveyed out of the particular pocket 22 by an ejector 50 and via a helical intermediate piece 51 right into a discharge conveyor 52. The latter consists likewise of upper and lower sides, between which are received the packs having hardened glue bonds. The intermediate piece 51 consists of oblique or arcuate guide walls as a transition from the pocket 22 to the discharge conveyor 52 extending in a horizontal plane.

The ejector 50 is designed as an angled arm with a horizontal leg 55 which, during the to-and-fro movement of the ejector 50, is moved through the pocket 22 to be emptied up to the discharge conveyor 52. The remaining part of the ejector 50 is mounted, so as to be displaceable, laterally next to the drying turret 18, specifically on essentially horizontal supporting rods 54 directed axis-parallel relative to the drying turret 18. The ejector 50 designed in this way is driven by means of a crank 55 with a revolving driving pulley 56 and a connecting rod 57. The latter is connected (pivotably) to a slide 58 carrying the ejector 50. This slide is mounted so as to slide on the supporting rods 54.

The outer annular wall 33 and the turret side-walls 44 and 45 of the drying turret 18 are interrupted or provided with recesses 59 and 60 in the region of the push-out station 32 and in the region of the feed station 31. The recess 59 in the region of the push-out station 32 allows the free passage of the ejector 50 or the leg 53.

The further design of the drying turret 18 in the present embodiment emerges, above all, from FIGS. 6 and 7. The turret side-walls 44 and 45 form together with the annular wall 33 a closed housing. The drive for the drying turret 18 is also accommodated in this. A main wheel 62 mounted on a fixed central axle 63 is driven via a toothed-wheel gear 61. The supporting disk 34, to the outer periphery of which the pockets 22 are attached, revolves together with the main wheel 62 and is therefore connected to it. The cam disk 41 is also arranged on the supporting disk 34 as a laterally projecting rim. The cam disk 29 assigned to the pockets 22 or to the moveable side wall 25 of these is connected to the axle 63. In the exemplary embodiment illustrated, the cam disk 29 is identical to the retaining disk 38, the outer periphery of this retaining disk 38 at the same time forming the cam disk 29. The retaining disk is provided with an orifice 64, through which passes the leg 39 of the pocket stop 35, together with the track roller 40, so as to come up against the cam disk 41.

In the present exemplary embodiment, the capacities of the drying turrets 14 and 18 are such that each pack is received for approximately 15 seconds in each drying turret. The total drying time of 30 seconds is sufficient to obtain stable packs. Like the first drying turret 14, the second drying turret 18 can be heated in a suitable way.

We claim:

1. An apparatus for producing cuboid packs with folding tabs joined by means of gluing, comprising:

first generally circular rotatable drying turret means (14) for receiving cuboid packs immediately after the gluing of the tabs thereof and for temporarily holding the packs in a predetermined cuboid configuration during substantial setting of the glued tabs;

second generally circular intermittently rotatable drying turret means (18), disposed downstream of said first turret means and having a periphery and an axis of rotation, for receiving said packs (10) and temporarily holding said packs during final setting of the glued tabs;

said second drying turret means (18) comprising pockets (22), each comprising means for receiving from said first turret means (14) a group (23) of packs (10) located next to one another in the axial direction of said second drying turret means (18);

feed conveyor means (17), disposed between said first and second turret means and extending in said axial direction of said second drying turret means (18), for sequentially transporting a plurality of packs (10) from said first drying turret means (14) to said second drying turret means (18) and for forming said group (23) from the packs (10) received by one of said pockets (22);

wherein each of said pockets is an axially extending continuous orifice having an exit end and a feed end;

wherein, in the region of a feed station (31) disposed adjacent the periphery of said second turret means, there is located at the exit end of the pockets pocket stop means (35) for providing a stop against which abuts the pack group (23) conveyed into a pocket through the feed end thereof, said stop means having a stop projection (36); and further comprising means, associated with said stop means, for moving said stop means outside the rotation path of the second drying turret means (18) during rotation thereof and, during the time when said second drying means (18) is stationary, for moving said stop projection (36) into the exit end of the pocket (22) to provide said stop.

2. An apparatus as claimed in claim 1, wherein the packs are arranged in each pocket with their narrow sides, especially their end faces (21), pointing inwards and outwards in the radial direction.

3. An apparatus as claimed in claim 1, comprising means for pushing the pack groups (23) into the pockets (22) in the axial direction through the feed end thereof and out of the exit end of the pockets (22) in the same direction at a push-out station offset in the peripheral direction from the second drying turret means (18).

4. An apparatus as claimed in claim 1, wherein the first drying turret means (14) and the second drying turret means (18) are arranged to rotate in vertical planes offset 90° relative to one another.

5. An apparatus as claimed in claim 1, wherein said feed conveyor transports the packs (10) directly into the feed end of the associated pocket (22) and forms the pack group (23) within the pocket (22), and further comprising clamping means for temporarily stopping the subsequent upstream packs (10) on the feed conveyor means (17).

6. An apparatus as claimed in claim 5 wherein said clamping means comprises a lateral guide wall (49) next to the feed conveyor means (17), at least in the region of the second drying turret means (18), and a moveable clamping plate means (46) located opposite said guide wall for clamping several packs (10) by pressing them against the lateral guide wall (49).

7. An apparatus as claimed in claim 1, wherein the pocket stop means (35) comprises a cam disk (41), a track roller (40) and a pivotable two-armed lever, on one end of which the stop projection (36) is located and the other end of which is supported on said cam disk (41) via said track roller (40).

8. An apparatus as claimed in claim 1, wherein each pocket (22) has two side walls (24 and 25), between which a pack group (23) is received, which are located opposite one another in the peripheral direction of the second drying turret means (18), and of which at least one side wall (25) is moveable.

9. An apparatus as claimed in claim 8, wherein the moveable side wall (25) of the pocket (22) is part of a pivotable spring-loaded two-armed wall lever (26), and comprising means, including a cam disk and a tracer roller (28), for controlling the position of said wall lever.

10. An apparatus as claimed in claim 3, wherein the feed station (31) is located at the height of a horizontal center plane of the second drying turret means (18), and said push-out station (32) is located underneath said feed station.

11. An apparatus as claimed in claim 10 comprising ejector means for ejecting a pack group (23) from a pocket (22) in the push-out station (32), and means for feeding an ejected pack group via a helical imtermediate piece (51) to a discharge conveyor (52) formed from conveyor belts.

12. An apparatus as claimed in claim 11, wherein said ejector means comprises an ejector (50) moveable through the pocket (22) in the axial direction.

13. An apparatus as claimed in claim 12, wherein said ejector has a leg, and wherein the pockets (22) are open laterally at least in the region of the push-out station (32), in such a way that said leg (53) of the ejector (50), mounted, so as to be displaceable, laterally next to the second drying turret means (18), is moveable through the pocket (22) in the axial direction.

* * * * *